US006918548B2

(12) United States Patent
Terakado et al.

(10) Patent No.: US 6,918,548 B2
(45) Date of Patent: Jul. 19, 2005

(54) ELECTRONIC FUEL INJECTOR

(75) Inventors: Katsuyoshi Terakado, Ibaraki (JP); Mizuho Yokoyama, Hitachinaka (JP); Arata Kagiyama, Ibaraki (JP); Noboru Baba, Hitachiohta (JP); Masahiro Souma, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 165 days.

(21) Appl. No.: 10/083,642

(22) Filed: Feb. 27, 2002

(65) Prior Publication Data

US 2003/0025003 A1 Feb. 6, 2003

(30) Foreign Application Priority Data

Aug. 3, 2001 (JP) ..... 2001-236801

(51) Int. Cl.[7] ..... B05B 1/34; B05B 1/26; B05B 1/30; F02M 51/00

(52) U.S. Cl. ..... 239/463; 239/461; 239/585.1; 239/585.2; 239/585.3; 239/585.4; 239/585.5

(58) Field of Search ..... 239/585.1, 585.2, 239/585.3, 585.4, 585.5, 461, 463, 533.2

(56) References Cited

U.S. PATENT DOCUMENTS

| | | | | | |
|---|---|---|---|---|---|
| 3,832,244 | A | * | 8/1974 | Pinnow et al. | 148/325 |
| 3,982,907 | A | * | 9/1976 | Honma | 75/236 |
| 4,129,443 | A | * | 12/1978 | Kaufman | 419/32 |
| 4,724,000 | A | * | 2/1988 | Larson et al. | 75/236 |
| 5,062,908 | A | * | 11/1991 | Purnell et al. | 148/332 |
| 5,362,337 | A | * | 11/1994 | Kosa | 148/325 |
| 5,466,276 | A | * | 11/1995 | Sato et al. | 75/231 |
| 5,979,801 | A | * | 11/1999 | Munezane et al. | 239/533.12 |
| 6,168,095 | B1 | * | 1/2001 | Seitter et al. | 239/533.3 |
| 6,286,769 | B1 | * | 9/2001 | Gunji et al. | 239/585.1 |
| 6,338,747 | B1 | * | 1/2002 | Kosco | 75/243 |

FOREIGN PATENT DOCUMENTS

| | | | | |
|---|---|---|---|---|
| EP | 1 188 920 A2 | | 3/2002 | |
| EP | 1 262 654 A1 | | 12/2002 | |
| JP | 61-232378 | | 10/1986 | |
| JP | 01301955 A | * | 12/1989 | F02M/61/18 |
| JP | 1-310165 | | 12/1989 | |
| WO | WO 01/55585 A1 | | 8/2001 | |

OTHER PUBLICATIONS

Askeland, D.R., "The Science and Engineering of Materials", 1991, Abstract No. XP002255562, pp. 393–397.

* cited by examiner

*Primary Examiner*—David A. Scherbel
*Assistant Examiner*—Darren Gorman
(74) *Attorney, Agent, or Firm*—Crowell & Moring LLP

(57) ABSTRACT

An electronic fuel injector capable of supplying fuel in a stable manner is provided by employing a swirler, which is manufactured at a lower cost and has durability, and by ensuring superior wear resistance of the swirler and a valve member provided on a movable part, which is put into frictional contact with the swirler. The electronic fuel injector comprises a movable part, a valve member, a valve seat, a swirler, a stopper, a stator core, a casing, a spring, and an electromagnetic coil. A valve member is provided at a fore end of the movable part. The swirler serves not only to swirl fuel, but also to guide movement of the valve member provided at the fore end of the movable part. The swirler is formed of a powder sintered compact of martensitic stainless steel having corrosion resistance and wear resistance.

17 Claims, 5 Drawing Sheets

ELECTRONIC FUEL INJECTOR

BACKGROUND OF THE INVENTION

1. Field of the Invention

The present invention relates to an electronic fuel injector for supplying a fuel spray to an automobile internal combustion engine, and more particularly to an electronic fuel injector suitable for use in the type of injector including a swirler.

2. Description of the Related Art

Conventional electronic fuel injectors for use with gasoline fuel, by way of example, are generally divided into two types, i.e., the ball type in which a movable part has a ball-shaped fore end as disclosed in Japanese Unexamined Patent Application Publication No. 1-310165, and the pintle type in which a movable part has a triangular fore end. Those two types are however substantially similar in both structure and function. More specifically, any type of electronic fuel injector comprises a stator core, an electromagnetic coil arranged concentric with the stator core, a casing made of a magnetic material and containing the stator core and the electromagnetic coil, a movable part having a valve member provided at its fore end, a stopper for stopping movement of the movable part, a valve seat arranged in an opposed relation to the stopper with the movable part interposed therebetween, and a spring engaging with one end of the movable part to press the movable part against the valve seat. When an electric current is supplied to the electromagnetic coil, a magnetic circuit is formed to generate an electromagnetic force. Upon the generated electromagnetic force overcoming a resilient force of the spring pressing the movable part, the valve member provided at the fore end of the movable part is moved away from the valve seat and the injector is opened. When the current is cut off, the valve member is moved into contact with the valve seat and the injector is closed.

In such a conventional electronic fuel injector, the movable part is vertically moved between the stopper and the valve seat. For the purpose of preventing the fore end of the movable part from wobbling laterally and ensuing the operation as smooth as possible, the electronic fuel injector includes a swirler put into frictional contact with the valve member provided at the fore end of the movable part. The swirler serves not only to guide the fore end of the movable part, but also to swirl fuel. Therefore, the swirler has such a complicated shape that grooves are formed as fuel passages in one surface of the swirler on the injection side so as to swirl the fuel. Because the swirler is put into frictional contact with the valve member under supply of high-pressure fuel and hence requires superior wear resistance, it is commonly manufactured by mechanically machining a material made of JIS-SUS440C, i.e., high-carbon and high-chromium martensitic stainless steel, with high precision, then quenching and tempering the material to harden it up to a level of about 60 HRC, and further finishing an inner cylindrical surface, etc. to remedy a deformation caused by heat treatment. As an alternative, in consideration of the fact that the grooves formed as fuel passages in the swirler have a complicated shape and mechanical machining of the swirler requires the increased number of steps and a longer working time, the swirler is manufactured by MIM (metal injection molding) using a powder of SUS440C, or by powder sintering using a powder of (Fe—Ni based) permalloy having low hardness and good fluidity when a high level of wear resistance is not required.

Of the swirlers used in conventional fuel injectors, one manufactured by mechanical machining of SUS440C has problems in that the number of machining steps is increased and the life of a cutter is shortened, because a SUS440C material, which is hard to machine, must be machined into the swirler including grooves of a complicated shape formed as fuel passages and having an inner cylindrical surface finished into a desired inner diameter with high precision, before the machined swirler is subjected to heat treatment. Further, when burrs and/or buckles, for example, remain in the swirler after the mechanical machining and the finishing, worn-out dust is generated upon wear of the swirler that is put into frictional contact with a valve member provided on a movable part. The generated worn-out dust acts as an abrasive and accelerates the wear of the swirler. If the worn-out dust is fixedly caught in a fuel sheet formed on a valve seat between itself and the valve member, there arises a risk of fuel leakage. Also, the swirler manufactured by MIM has problems in that a post-process is needed due to a difficulty in achieving the required accuracy by MIM alone, and hence the production cost is pushed up. Further, the swirler manufactured by powder sintering has problems in that because the used powdery raw material is relatively soft, satisfactory dimensional accuracy can be obtained, but wear resistance is poor.

The above-mentioned problems are more significant particularly in a direct-injection combustion system in which an increased surface pressure occurs between the swirler and the counterpart, i.e., the valve member provided on the movable part and put into frictional contact with the swirler. More specifically, the fuel pressure rises to a level of 7 to 15 MPa in the direct-injection combustion system, and a much higher surface pressure than that in an ordinary combustion system is applied to between the swirler and the valve member provided on the movable part. This brings the swirler into an abrasively worn state in which both friction wear and impact wear occur, whereby worn-out dust is generated. The generated worn-out dust acts as an abrasive and accelerates the both types of wear of the swirler. In the case of mechanically machining a SUS440C material that is used in many swirlers of conventional electronic fuel injectors, the swirler has hardness as high as about 60 HRC as a result of quenching and tempering, and hence a relatively good level of wear resistance is obtained. However, because the swirler and the counterpart, i.e., the valve member provided on the movable part, are made of the same material, inter-molecular coupling tends to easily occur due to the friction wear, and hence the swirler having such a material combination cannot be said as being optimum. Further, not a few burrs and/or buckles occur in the swirler with the mechanical machining thereof into a complicated shape, and they must be removed in a post-process such as barrel polishing. The burrs and/or buckles remaining in spite of the post-process generate abrasive dust in many cases.

SUMMARY OF THE INVENTION

Accordingly, it is an object of the present invention to provide an electronic fuel injector capable of supplying fuel in a stable manner by employing a swirler, which is manufactured at a lower cost and has durability, and by ensuring superior wear resistance of the swirler and a valve member provided on a movable part, which is put into frictional contact with the swirler.

(1) To achieve the above object, according to the present invention, there is provided an electronic fuel injector comprising a movable part having a valve member provided at a fore end of the movable part, and a swirler for swirling fuel and guiding movement of the valve member provided at the fore end of the movable part, wherein the swirler is formed of a powder sintered compact of stainless steel having corrosion resistance and wear resistance.

With that feature, the fuel can be stably supplied by employing the swirler, which is manufactured at a lower cost and has durability, so that superior wear resistance is ensured for the swirler and the valve member.

(2) In above (1), preferably, martensitic stainless steel is used as a material of the swirler formed of a powder sintered compact.

(3) In above (1), preferably, the swirler formed of a powder sintered compact has hardness not less than 90 HRB after sintering.

(4) In above (1), preferably, the swirler formed of a powder sintered compact has density not less than 6.5 after sintering.

DESCRIPTION OF THE PREFERRED EMBODIMENTS

The construction of an electronic fuel injector according to one embodiment of the present invention will be described below with reference to FIGS. 1 to 5. Note that the following description is made of, by way of example, an electronic fuel injector for direct injection of gasoline engine, but the present invention can also be similarly applied to an electronic fuel injector for use with alcohol fuel or gaseous fuel and an electronic fuel injector for ejecting fuel into an intake manifold (or an intake port).

First, the overall construction of the electronic fuel injector of this embodiment is described with reference to FIG. 1.

Figure 1:
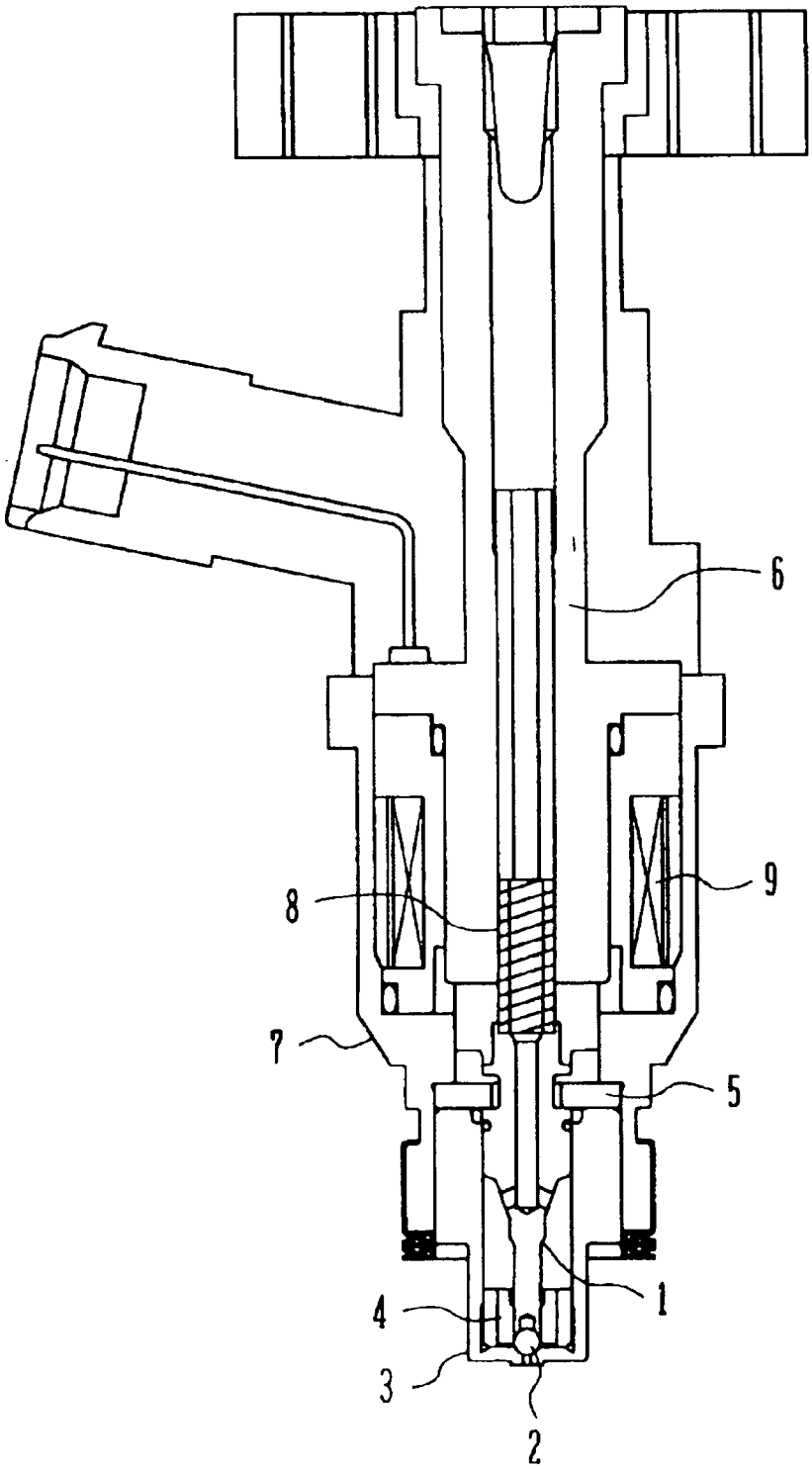
FIG. 1 is a sectional view showing an overall construction of an electronic fuel injector according to one embodiment of the present invention.

FIG. 1 is a sectional view showing the overall construction of the electronic fuel injector according to one embodiment of the present invention.

The electronic fuel injector of this embodiment comprises a movable part 1, a valve member 2, a valve seat 3, a swirler 4, a stopper 5, a stator core 6, a casing 7, a spring 8, and an electromagnetic coil 9. The electromagnetic coil 9 is arranged concentric with the stator core 6. The casing 7 is made of a magnetic material and contains the stator core 6 and the electromagnetic coil 9. A ball-shaped valve member 2 is provided at a fore end of the movable part 1. The stopper 5 is provided for stopping movement of the movable part 1. The valve seat 3 is arranged in an opposed relation to the stopper 5 with the movable part 1 interposed therebetween. The spring 8 engages with one end of the movable part 1 to press the movable part 1 against the valve seat 3. The swirler 4 serves not only to guide the valve member 2 provided at the fore end of the movable part 1, but also to swirl fuel.

When an electric current is supplied to the electromagnetic coil 9, a magnetic circuit is formed to generate an electromagnetic force. Upon the generated electromagnetic force overcoming a resilient force of the spring 8 pressing the movable part 1, the valve member 2 provided at the fore end of the movable part 1 is moved away from the valve seat 3 upward so that the fuel is sprayed. When the current supplied to the electromagnetic coil 9 is cut off, the movable part 1 is pushed by the spring 8 and the valve member 2 is brought into contact with the valve seat 3 for airtight closing, whereby the fuel spray is stopped. Thus, the start and stop of injection of the fuel spray are controlled by turning on and off the supply of an electric current to the electromagnetic coil 9. As a result, the amount of injected fuel can be controlled.

Next, the construction of a fore end portion of the electronic fuel injector according to this embodiment will be described with reference to FIG. 2.

Figure 2:
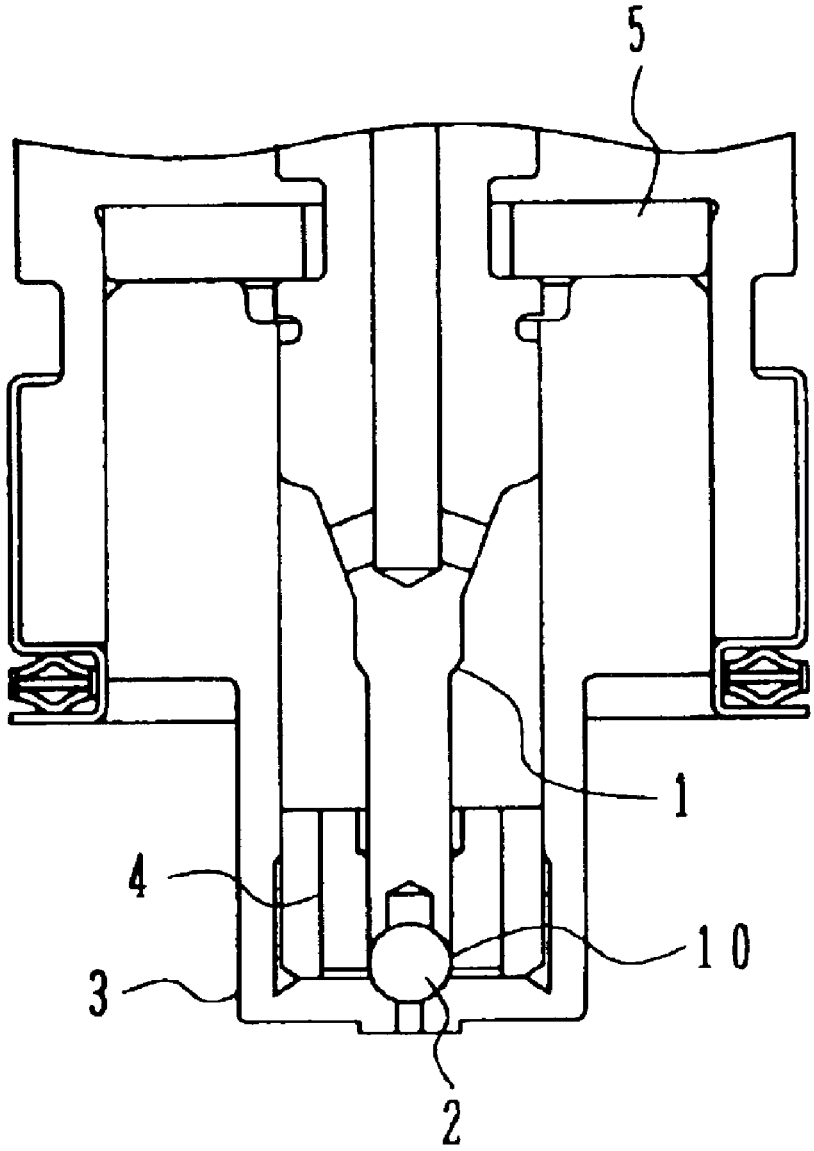
FIG. 2 is an enlarged sectional view showing a construction of a fore end portion of the electronic fuel injector according to one embodiment of the present invention.

FIG. 2 is an enlarged sectional view showing the construction of the fore end portion of the electronic fuel injector according to one embodiment of the present invention.

The ball-shaped valve member 2 is provided at the fore end of the movable part 1. The valve seat 3 is arranged in an opposed relation to the stopper 5 with the movable part 1 interposed therebetween. The swirler 4 serves not only to guide the valve member 2 provided at the fore end of the movable part 1, but also to swirl fuel. Therefore, friction wear occurs in a contact portion 10 of the swirler 4 between an inner cylindrical surface thereof and an outer periphery of the valve member 2 upon operation of the movable part 1.

Next, the construction of the swirler used in the electronic fuel injector according to this embodiment will be described with reference to FIG. 3.

Figure 3:
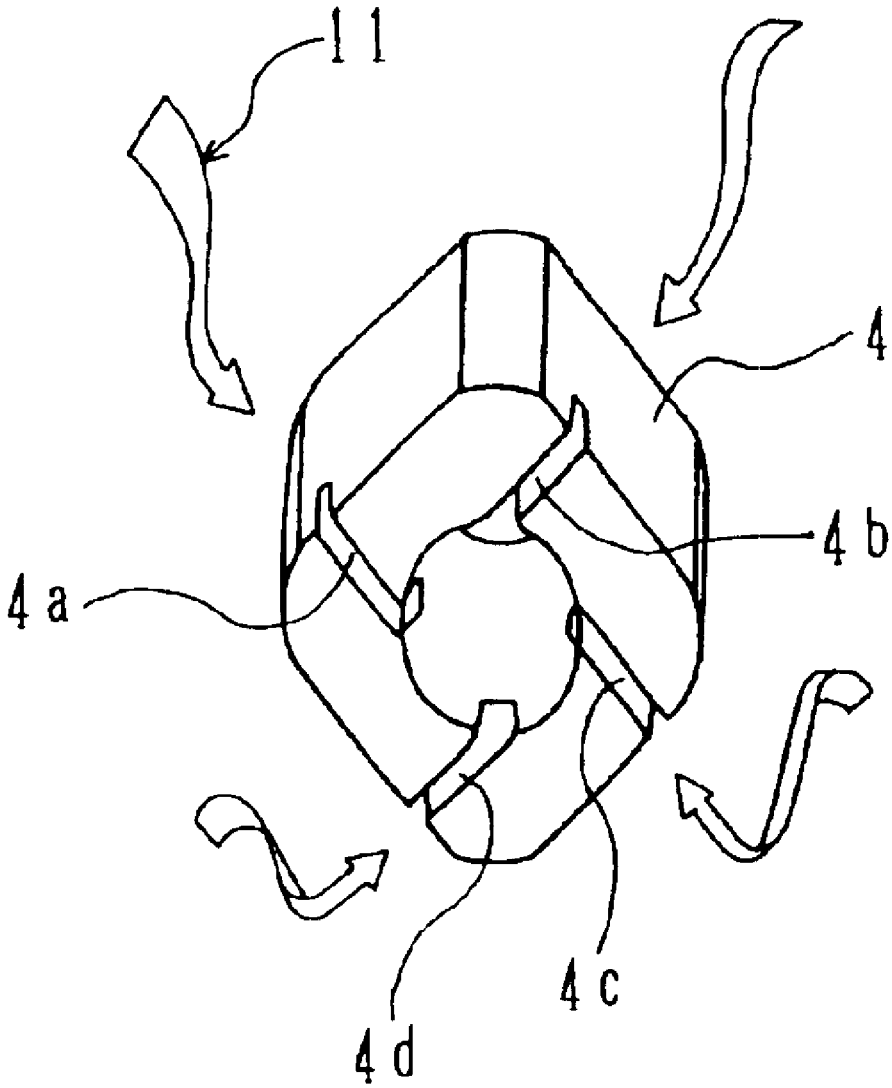
FIG. 3 is an enlarged perspective view showing a construction of a swirler used in the electronic fuel injector according to one embodiment of the present invention.

FIG. 3 is an enlarged perspective view showing the construction of the swirler used in the electronic fuel injector according to one embodiment of the present invention.

The swirler 4 has grooves 4*a*, 4*b*, 4*c* and 4*d* formed in its bottom surface, i.e., in its surface coming into contact with the valve seat 3 shown in FIG. 2, for swirling gasoline fuel 11. The gasoline fuel 11 supplied under high pressure for direct injection is given with a swirling force while passing through the grooves 4*a*, 4*b*, 4*c* and 4*d*, and is then directly injected into a combustion chamber through the valve seat 3. The fuel given with a swirling force is effective in preventing the fuel from remaining unburned after explosive combustion in the combustion chamber, greatly contributing to making exhaust gas more clean, and promoting fuel atomization for improved startability in cold weather.

The method for manufacturing the swirler 4 used in the electronic fuel injector according to this embodiment will be described below.

SUS410L was employed as a powdery raw material of the swirler 4. SUS410L contained chemical components (wt/%) of 0.10C-0.85Si-0.15Mn-0.017P-0.006S-0.10Ni-12.5Cr-Ba 1/Fe. Also, SUS410L had a grain size distribution (wt/%) of 0.1: +100, 5.2: −100/+145, 16.5: −145/+200/+250, 21.6: −250/+350, and 44.1: −350.

The powdery raw material was mixed with a lubricant. A mixture was filled in a mold for forming a powder compact, i.e., a swirler, and then molded under a press load of 11.5 t.

Subsequently, a number of molded swirlers were put in a continuous baking furnace, called a pusher furnace, for sintering. The swirlers were set in the furnace such that four stages of alumina-based trays were arranged in a graphite case of W200×L100×H250 and 600 pieces of swirlers were set in each tray. An atmosphere in the continuous baking furnace was adjusted using decomposed gases of ammonia, and had a gas composition of 25% $N_2$ gas and 75% $H_2$ gas. The sintering was carried out through the steps of removing the lubricant in the temperature range of 500 to 700° C., sintering the swirlers at a temperature of 1240° C., and tempering them.

As a result, the manufactured swirlers had hardness of 98 to 105 HRB and density of 7.08 to 7.17 after the sintering. A metal microstructure of each swirler was a mixed one of the martensitic structure and the fine pearlite structure.

Experimental results of wear depths of the swirler and the ball-shaped valve member used in the electronic fuel injector of this embodiment will now be described with reference to FIG. 4.

FIG. 4 is a graph for explaining experimental results of wear depths of the swirler and a ball-shaped valve member used in the electronic fuel injector according to one embodiment of the present invention.

Figures 4A, 4B, 4C:
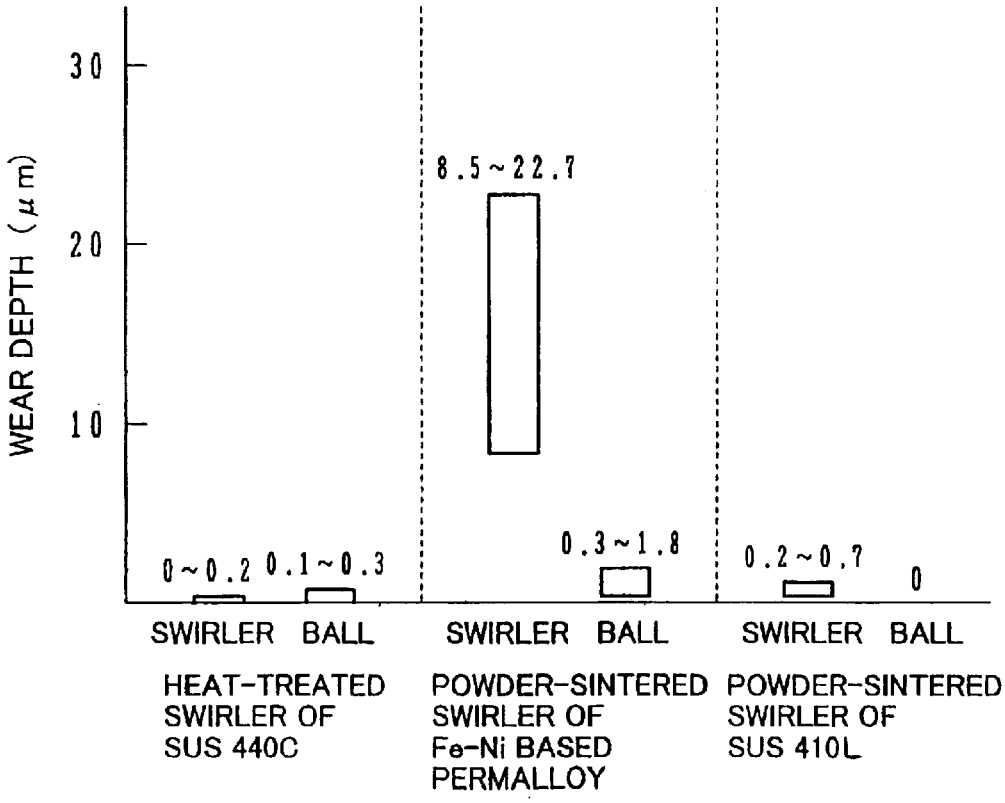
FIG. 4 is a graph for explaining experimental results of wear depths of the swirler and a ball-shaped valve member used in the electronic fuel injector according to one embodiment of the present invention.

An electronic fuel injector for direct injection, having the construction shown in FIG. 1, was fabricated using the swirler manufactured by powder sintering in accordance with the manufacturing method described above, and was then subjected to an operation durability test of 1 billion cycles. FIG. 4C shows results of wear amounts of a worn area of the inner cylindrical surface of the swirler 4 and the outer periphery of the valve member (ball) 2, which were obtained by measuring the dimensions of both the components before and after the test. The wear amounts were each measured by determining a wear depth with a surface roughness measuring device. SUS440C having a hardness of 60 HRC was used as a material of the valve member 2.

For comparison, FIG. 4A shows respective wear depths of a conventional swirler manufactured by mechanically machining SUS440C and the valve member (ball). This swirler had a high hardness of 60 HRC. FIG. 4B shows respective wear depths of a powder-sintered swirler made of Fe—Ni based permalloy having a hardness of 80 HRB and the valve member (ball).

As is understood from the experimental results shown in FIGS. 4A to 4C, the wear depth of the conventional swirler made of SUS440C and having a high hardness, shown in FIG. 4A, was 0 to 0.2 $\mu$m and minimum among the three types of swirlers, but the surface of the counterpart, i.e., the valve member 2, was worn in depth of 0.1 to 0.3 $\mu$m.

Further, as shown in FIG. 4B, the powder-sintered swirler made of permalloy exhibited a maximum wear depth of 8.5 to 22.7 $\mu$m, and the valve member was also worn in depth of 0.3 to 1.8 $\mu$m. The reason why the valve member having a hardness of 60 HRC was worn resides presumably in that worn-out dust is generated due to wear of the swirler and serves as an abrasive, which abrades the surface of the valve member and causes wear thereof.

On the other hand, as shown in FIG. 4C, in the fuel injector using the powder-sintered swirler made of SUS410L according to this embodiment, the wear depth of the inner cylindrical surface of the swirler was 0.2 to 0.7 $\mu$m, but the wear depth of the valve member was substantially zero. The reasons why the wear depth of the valve member was substantially zero are presumably as follows. First, since this embodiment employs the powder-sintered swirler, fuel having entered pores formed in the swirler during the sintering step serves as a lubricant and contributes to lessening wear of the ball (i.e., the valve member). That point is similarly applied to the comparative case shown in FIG. 4B. Secondly, since the swirler of this embodiment has a higher hardness than the swirler of FIG. 4B, the former swirler is less worn. Less wear of the swirler reduces the amount by which worn-out powder is attached to the ball side. Wear caused upon the swirler and the ball rubbing with each other can be thereby reduced. In this embodiment, therefore, the wear depth of the ball becomes substantially zero.

Stated otherwise, when the swirler and the ball have the same high hardness as with the conventional case of FIG. 4A, the wear amount is small, but the swirler and the ball are both worn. Also, when the hardness of the swirler is fairly smaller than that of the ball as with the comparative case of FIG. 4B, wear of the swirler is increased and wear of the ball is also increased correspondingly. In contrast, when the hardness of the swirler is set to be somewhat smaller than that of the ball as with this embodiment shown in FIG. 4C, the wear of the ball can be made substantially zero while the wear of the swirler is held down small.

With this embodiment, since the wear of the ball can be made substantially zero, it is possible to almost completely preventing worn-out dust from generating from the ball, and to reduce a fuel leakage that would otherwise occur upon the worn-out dust being fixedly caught in a fuel sheet formed on the valve seat between itself and the valve member. Also, since the swirler is manufactured by powder sintering, the manufacturing process can be simplified and the cost can be reduced.

In addition, it was confirmed that fuel (oil) tightness between the valve member 2 and the valve seat 3 after the operation durability test was 0.15 to 0.7 $mm^3$/min within a specified value of 1.0 $mm^3$/min in the conventional fuel injector using the swirler made of SUS440C, whereas the comparative fuel injector using the powder-sintered swirler made of permalloy had fuel tightness of 0.75 to 3.3 $mm^3$/min beyond the specified value and was not able to ensure a satisfactory level of fuel tightness.

In the fuel injector using the powder-sintered swirler made of SUS410L according to this embodiment, the fuel tightness was 0.17 to 0.8 $mm^3$/min comparable to that in the conventional fuel injector using the swirler made of SUS440C and having a high hardness, and hence a satisfactory level of fuel tightness was ensured.

Other experimental results of wear depths of the swirler used in the electronic fuel injector of this embodiment will now be described with reference to FIG. 5.

Figure 5:
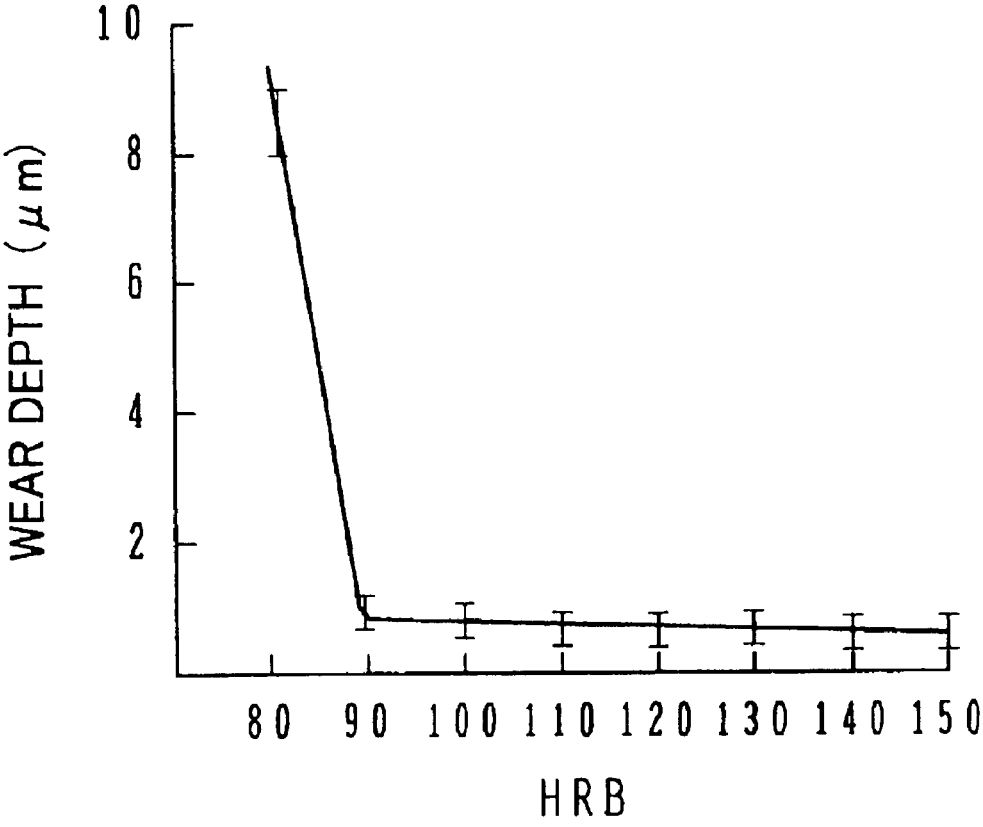
FIG. 5 is a graph for explaining other experimental results of wear depths of the swirler used in the electronic fuel injector according to one embodiment of the present invention.

FIG. 5 is a graph for explaining other experimental results of wear depths of the swirler used in the electronic fuel injector according to one embodiment of the present invention.

The powder-sintered swirler made of SUS410L, shown in FIG. 4C, had hardness of 98 to 105 HRB after the sintering. The hardness of the powder-sintered swirler can be varied by changing sintering conditions (such as sintering temperature and composition of decomposed gases). In view of the above, powder-sintered swirlers having different values of hardness were manufactured while changing the sintering conditions, and wear depths of those swirlers were measured by carrying out a similar experiment on each swirler as described above in connection with FIG. 4.

As seen from measured results plotted in FIG. 5, the wear depth was as small as 1 $\mu$m in any of the powder-sintered swirlers having hardness not less than 90 HRB. In the powder-sintered swirler having a hardness of 80 HRB, however, the wear depth was abruptly increased to a level of 8 to 9 μm. In other words, the wear of the swirler can be reduced by setting the hardness of the powder-sintered swirler to be not less than 90 HRB.

Herein, the hardness of the powder-sintered swirler corresponds to density thereof in a one-to-one relation. When the hardness of the powder-sintered swirler should be not less than 90 HRB, this means that the density should be not less than 6.5. Thus, by setting the density of the powder-sintered swirler to be not less than 6.5, wear of the swirler can be reduced.

In the embodiment described above, the metal microstructure of the powder-sintered swirler made of SUS410L is a martensitic structure, and wears of both the swirler and the ball can be reduced by forming the swirler with powder sintering of martensitic stainless steel. However, stainless steel usable as materials of the powder-sintered swirler is not limited to martensitic steel, but may be ferritic or austenitic stainless steel. Among several types of martensitic stainless steel, low-carbon SUS410 and lower-carbon SUS410L are preferable because high precision is required in the powder sintering and the powder is required to have good fluidity in the step of molding a powder compact. Incidentally, it was confirmed that, in spite of being martensitic, SUS420J2 was inferior in moldability to SUS410L.

The swirler is required to have high wear resistance not in an ordinary combustion system using gasoline fuel, but particularly in the case where a surface pressure between the swirler and the valve member, which is provided at the fore end of the movable part and put into frictional contact with the swirler, is increased and wear is more apt to occur. That case includes, for example, an electronic fuel injector used in a direct-injection combustion system in which fuel pressure is raised to a level of 20 to 100 times normal pressure and pressurized fuel is directly sprayed into a combustion chamber from the fuel injector to reduce carbon dioxide and NOx gases mixed in exhaust gas, or an electronic fuel injector used in a gas combustion system in which gaseous fuel, such as propane, is employed to make exhaust gas more clean. The powder-sintered swirler of this embodiment is particularly effective when used in those electronic fuel injectors.

By forming a swirler with powder sintering of a SUS410-series material in accordance with this embodiment and employing the swirler in an electronic fuel injector for a direct-injection combustion system in which fuel is directly sprayed into a combustion chamber, the following advantages are obtained unlike the case of utilizing mechanical machining that differs in basic concept. Because of the powder compacting using a mold, the swirler having grooves of complicated shape and an inner cylindrical surface of high precision can be molded in one step. It is therefore possible to noticeably simplify the manufacturing process and reduce the number of steps, and hence to achieve a reduction in cost. Also, burrs and/or buckles are hardly caused and, even though occurred, they can be easily removed by, e.g., barrel polishing performed after the sintering. Hence, wear and worn-out dust generated due to the remaining burrs and/or buckles can be reduced. Further, since a powdery material of martensitic stainless steel is used, the swirler has a high hardness after the sintering and high wear resistance can be ensured. From the dimensional point of view, although the swirler is subjected to slight shrinkage during the sintering, a shrinkage rate is known beforehand and the swirler having high dimensional accuracy can be relatively easily obtained by adjusting dimensions of the swirler before the sintering based on the sizes of a powder compacting mold.

With this embodiment, as described above, since the swirler is manufactured by powder sintering that is a low-cost production process and gives high wear resistance to the swirler, an electronic fuel injector can be obtained which is able to ensure stable fuel supply and is superior in both fuel flow characteristics and durability.

According to the electronic fuel injector of the present invention, as is apparent from the above description, stable fuel supply can be achieved by employing the swirler, which is manufactured at a lower cost and has durability, so that superior wear resistance is ensured for the swirler and a valve member provided on a movable part, which is put into frictional contact with the swirler.

What is claimed is:

1. An electronic fuel injector comprising a movable part having a valve member provided at a fore end of said movable part, and a swirler for swirling fuel and guiding movement of said valve member provided at the fore end of said movable part, wherein said valve member is made of SUS440C, wherein said swirler is formed of a powder sintered compact of stainless steel having corrosion resistance and wear resistance, wherein martensitic stainless steel, ferritic stainless steel, or austenitic stainless steel including SUS410, SUS410L, and SUS440C is used as a material of said swirler formed of a powder sintered compact, and wherein said swirler formed of a powder sintered compact has a hardness which is smaller than a hardness of said valve member and which is not less than 90 HRB after sintering.

2. An electronic fuel injector according to claim 1, wherein said swirler formed of a powder sintered compact has a density which is not less than 6.5 after sintering.

3. An electronic fuel injector comprising a movable part having a valve member provided at a fore end of said movable part, and a swirler for swirling fuel and guiding movement of said valve member provided at the fore end of said movable part, wherein said swirler is formed of a powder sintered compact of stainless steel having corrosion resistance and wear resistance, and wherein a hardness of said swirler is smaller than hardness of said valve member.

4. An electronic fuel injector according to claim 3, wherein martensitic stainless steel is used as a material of said swirler formed of a powder sintered compact.

5. An electronic fuel injector according to claim 3, wherein said swirler formed of a powder sintered compact has a hardness not less than 90 HRB after sintering.

6. An electronic fuel injector according to claim 3, wherein said swirler formed of a powder sintered compact has a density not less than 6.5 after sintering.

7. An electronic fuel injector according to claim 3, wherein said swirler is spherical.

8. An electronic fuel injector according to claim 3, wherein a wear depth of said swirler is less than 0.7 μm.

9. An electronic fuel injector according to claim 3, wherein fuel tightness of said swirler is 0.15 to 0.8 $mm^3$/min.

10. An electronic fuel injector comprising a movable part having a valve member provided at a fore end of said movable part, and a swirler for swirling fuel and guiding movement of said valve member provided at the fore end of said movable part, wherein said swirler is formed of a powder sintered compact of stainless steel having corrosion resistance and wear resistance, and wherein said swirler wears and said valve member does not wear when said valve member contacts with said swirler by operation of said movable part.

11. An electronic fuel injector according to claim 10, wherein martensitic stainless steel is used as a material of said swirler formed of a powder sintered compact.

12. An electronic fuel injector according to claim 10, wherein said swirler formed of a powder sintered compact has a hardness not less than 90 HRB after sintering.

13. An electronic fuel injector according to claim 10, wherein said swirler formed of a powder sintered compact has a density not less than 6.5 after sintering.

14. An electronic fuel injector according to claim 10, wherein said swirler is spherical.

15. An electronic fuel injector according to claim 10, wherein a hardness of said swirler is smaller than a hardness of said valve member.

16. An electronic fuel injector according to claim 10, wherein a wear depth of said swirler is less than 0.7 $\mu$m.

17. An electronic fuel injector according to claim 10, wherein fuel tightness of said swirler is 0.15 to 0.8 $mm^3$/min.

* * * * *